US011415346B2

(12) United States Patent
Peppard et al.

(10) Patent No.: US 11,415,346 B2
(45) Date of Patent: Aug. 16, 2022

(54) SYSTEM AND METHOD FOR COMMON SIDE CONNECTIONS FOR OVERSIZED MULTISLAB MICROCHANNEL HEAT EXCHANGER

(71) Applicant: TRANE INTERNATIONAL INC., Davidson, NC (US)

(72) Inventors: Gregory M. Peppard, Clarksville, TN (US); Chad Daniel Bowers, Adams, TN (US); Jennifer L. Caudill, Crofton, KY (US)

(73) Assignee: TRANE INTERNATIONAL INC., Davidson, NC (US)

( * ) Notice: Subject to any disclaimer, the term of this patent is extended or adjusted under 35 U.S.C. 154(b) by 121 days.

(21) Appl. No.: 16/863,772

(22) Filed: Apr. 30, 2020

(65) Prior Publication Data

US 2021/0341189 A1 Nov. 4, 2021

(51) Int. Cl.

| | |
|---|---|
| ***F25B 39/02*** | (2006.01) |
| ***F25B 39/00*** | (2006.01) |
| *F25B 5/02* | (2006.01) |
| *F25B 6/02* | (2006.01) |

(52) U.S. Cl.

CPC ..... *F25B 39/00* (2013.01); *F25B 5/02* (2013.01); *F25B 6/02* (2013.01); *F25B 39/028* (2013.01)

(58) Field of Classification Search

CPC ..... F25B 39/00; F25B 39/028; F25B 39/04; F25B 5/02; F25B 6/02; F28D 1/0452; F28D 1/053; F28D 1/05391; F28D 1/0443; F28D 2021/0071; F28D 2021/0084

See application file for complete search history.

(56) References Cited

U.S. PATENT DOCUMENTS

| | | | |
|---|---|---|---|
| 4,998,580 | A | 3/1991 | Guntly et al. |
| 5,529,116 | A | 6/1996 | Sasaki et al. |
| 6,988,538 | B2 | 1/2006 | Merkys et al. |
| 9,016,352 | B2 | 4/2015 | Helbig et al. |
| 10,151,538 | B2 | 12/2018 | Lee et al. |

(Continued)

FOREIGN PATENT DOCUMENTS

WO 2014/205799 A1 12/2014

OTHER PUBLICATIONS

Extended European Search Report, European Patent Application No. 21170480.4, dated Sep. 29, 2021 (7 pages).

*Primary Examiner* — Len Tran
*Assistant Examiner* — Kamran Tavakoldavani
(74) *Attorney, Agent, or Firm* — Hamre Schumann, Mueller & Larson, P.C.

(57) ABSTRACT

A multi-slab microchannel heat exchanger is disclosed. The heat exchanger includes a first slab having a first inlet header and a first outlet header, a second slab including a second inlet header and a second outlet header, a first inlet connector fluidly connected to the first inlet header, a first outlet connector fluidly connected to the first outlet header, a second inlet connector fluidly connected to the second inlet header, and a second outlet connector fluidly connected to the second outlet header. The first slab and the second slab are arranged successively in a direction along a length of the heat exchanger. The first inlet connector, the first outlet connector, the second inlet connector, and the second outlet connector are disposed at a same end of the heat exchanger.

10 Claims, 8 Drawing Sheets

(56) References Cited

U.S. PATENT DOCUMENTS

| | | | | |
|---|---|---|---|---|
| 10,323,868 | B2 | 6/2019 | Winters et al. | |
| 2005/0161202 | A1 | 7/2005 | Merkys et al. | |
| 2006/0130517 | A1* | 6/2006 | Merkys | F28D 1/05383 62/515 |
| 2009/0225514 | A1 | 9/2009 | Correa et al. | |
| 2011/0056668 | A1* | 3/2011 | Taras | F28F 1/022 165/174 |
| 2013/0180695 | A1 | 7/2013 | Seo et al. | |
| 2013/0312441 | A1 | 11/2013 | Fritz | |
| 2019/0154342 | A1 | 5/2019 | Junfeng et al. | |
| 2020/0033033 | A1 | 1/2020 | Yoshioka et al. | |

* cited by examiner

SYSTEM AND METHOD FOR COMMON SIDE CONNECTIONS FOR OVERSIZED MULTISLAB MICROCHANNEL HEAT EXCHANGER

FIELD

This disclosure relates generally to microchannel heat exchangers. More specifically, the disclosure relates to systems and methods using common side connections for an oversized multi-slab microchannel heat exchanger.

BACKGROUND

A microchannel heat exchanger typically includes an inlet header, an outlet header, and a plurality of flat tubes connecting to and communicating with the headers. Each of the flat tubes has microchannels or small pathways for refrigerant (gas or liquid) to pass through. During operation, in a microchannel heat exchanger, refrigerant enters the inlet header via an inlet of the inlet header, then the refrigerant enters the flat tubes having microchannels, and the refrigerant conducts heat exchange with a fluid external to the flat tubes (e.g., air) to provide cooling or heating when the refrigerant flows within the flat tubes. After heat exchanging with the external fluid, the refrigerant leaves the flat tubes, enters the outlet header, and leaves the outlet header via an outlet of the outlet header.

SUMMARY

This disclosure relates generally to microchannel heat exchangers. More specifically, the disclosure relates to systems and methods using common side connections for an oversized multi-slab microchannel heat exchanger.

In an embodiment, a multi-slab microchannel heat exchanger is disclosed. The heat exchanger includes a first slab having a first inlet header and a first outlet header, a second slab including a second inlet header and a second outlet header, a first inlet connector fluidly connected to the first inlet header, a first outlet connector fluidly connected to the first outlet header, a second inlet connector fluidly connected to the second inlet header, and a second outlet connector fluidly connected to the second outlet header. The first slab and the second slab are arranged successively in a direction along a length of the heat exchanger. The first inlet connector, the first outlet connector, the second inlet connector, and the second outlet connector are disposed at a same end of the heat exchanger. The first slab includes a first plurality of tubes. The first plurality of tubes is arranged successively in the direction along the length of the heat exchanger. Each of the first plurality of tubes includes microchannels. The first plurality of tubes includes inlets and outlets. The inlets of the first plurality of tubes are in fluid communication with the outlets of the first plurality of tubes through the microchannels of the plurality of tubes. The first inlet header is in fluid communication with the inlets of the first plurality of tubes. The first outlet header is in fluid communication with the outlets of the first plurality of tubes.

In an embodiment, the second slab has the same structure as (or similar structure to) the first slab. In an embodiment, the first slab and the second slab are a mirror image of each other.

In an embodiment, the first inlet connector, the first outlet connector, the second inlet connector, and the second outlet connector are disposed at a bottom of the heat exchanger.

In an embodiment, the first slab and the second slab converge at a point in the direction along the length of the heat exchanger. The second inlet connector and the second outlet connector extend from the point to the same end of the heat exchanger in the direction along the length of the heat exchanger.

In an embodiment, the second inlet connector is disposed inside the second outlet connector. The second inlet connector and the second outlet connector extend concentrically from the point to the same end of the heat exchanger in the direction along the length of the heat exchanger.

In an embodiment, the second outlet connector is disposed inside the second inlet connector. The second inlet connector and the second outlet connector extend concentrically from the point to the same end of the heat exchanger in the direction along the length of the heat exchanger.

In an embodiment, the second inlet connector is disposed inside the first inlet header. The second inlet connector and the first inlet header extend concentrically from the point to the same end of the heat exchanger in the direction along the length of the heat exchanger.

In an embodiment, the second outlet connector is disposed inside the first outlet header. The second inlet connector and the first outlet header connector extend concentrically from the point to the same end of the heat exchanger in the direction along the length of the heat exchanger.

In an embodiment, the first inlet connector and the first outlet connector are made of aluminum. In an embodiment, the second inlet connector and the second outlet connector are made of aluminum.

In an embodiment, the multi-slab microchannel heat exchanger further includes a third slab, a third inlet connector, and a third outlet connector. The first slab, the second slab, and the third slab are arranged successively in the direction along the length of the heat exchanger.

In an embodiment, the first inlet connector, the first outlet connector, the second inlet connector, the second outlet connector, the third inlet connector, and the third outlet connector are disposed at the same end of the heat exchanger.

It will be appreciated that the above embodiments are merely illustrative of the technical concept and features of the multi-slab microchannel heat exchanger, and these embodiments are to make a person skilled in the art understand the contents of the multi-slab microchannel heat exchanger and to implement the multi-slab microchannel heat exchanger without limiting the scope of protection of the multi-slab microchannel heat exchanger. Any features described in one embodiment can be combined with or incorporated/used into the other embodiment, and vice versa. The equivalent change or modification according to the substance of the multi-slab microchannel heat exchanger should be covered by the scope of protection of the multi-slab microchannel heat exchanger.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTIONS

Figure 1:
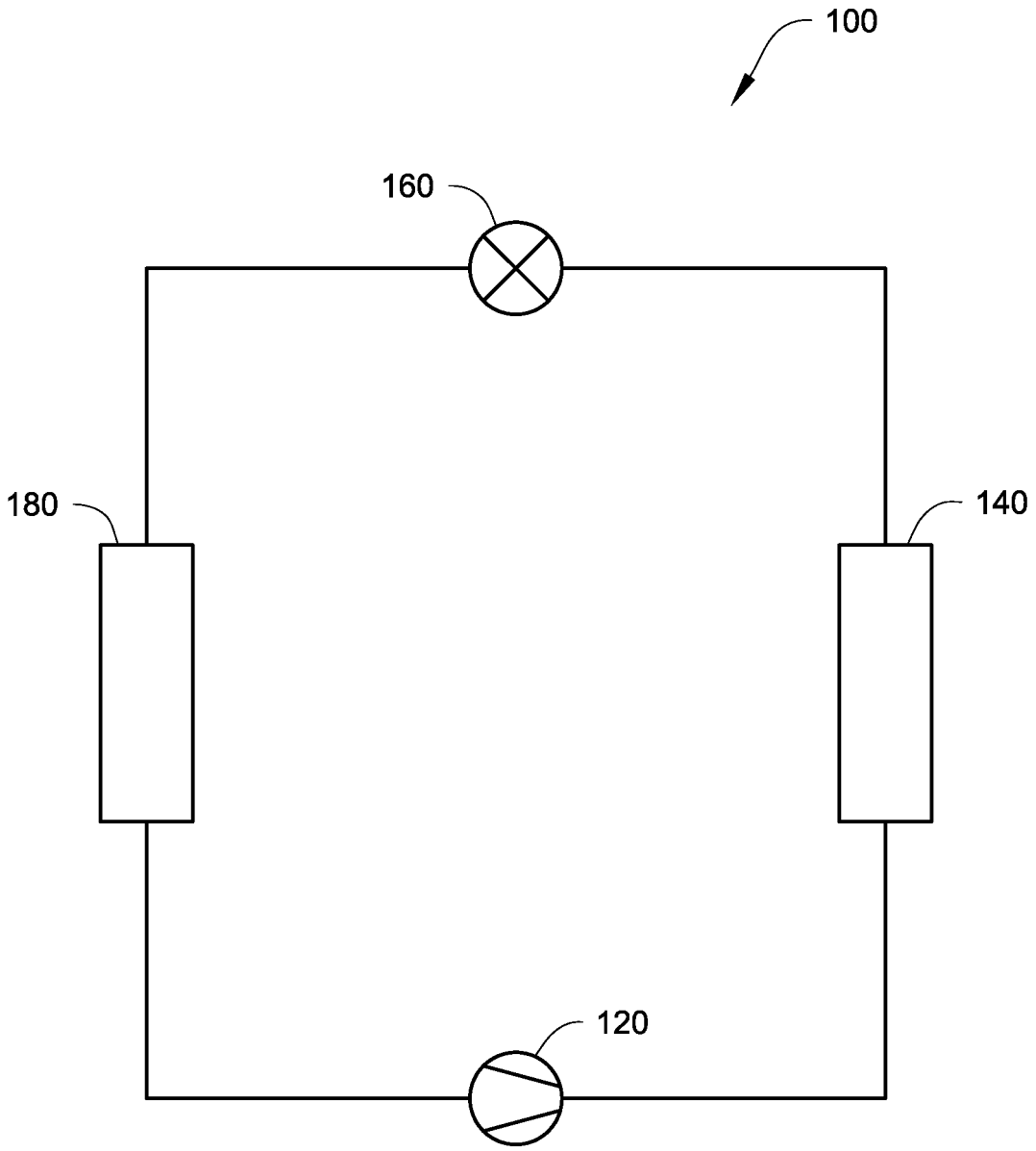
FIG. 1 is a schematic diagram of a refrigeration circuit, according to an embodiment.

This disclosure relates generally to microchannel heat exchangers. More specifically, the disclosure relates to systems and methods using common side connections for an oversized multi-slab microchannel heat exchanger.

Some embodiments of the present application are described in detail with reference to the accompanying drawings so that the advantages and features of the present application can be more readily understood by those skilled in the art. The terms "near", "far", "top", "bottom", "left", "right" and the like described in the present application are defined according to the typical observation angle of a person skilled in the art and for the convenience of the description. These terms are not limited to specific directions. For example, for FIG. 2, a "near" side can correspond to the left side of the paper, and a "far" side can correspond to the right side of the paper.

In an embodiment, a microchannel heat exchanger includes an inlet header and an outlet header, flat microchannel multiport tubes, and fins. These components are typically brazed together with non-corrosive fluxes. These components are typically made of aluminum or aluminum alloys, distinct in their composition and dads. During operation, in the microchannel heat exchanger, refrigerant enters the inlet header via an inlet of the inlet header, then the refrigerant enters the flat tubes having microchannels, and the refrigerant conducts heat exchange with a fluid external to the flat tubes (e.g., air) to provide cooling or heating when the refrigerant flows within the flat tubes. After heat exchanging with the external fluid, the refrigerant leaves the flat tubes, enters the outlet header, and leaves the outlet header via an outlet of the outlet header.

Due to the constraints of the manufacturing process(s) and/or production means, there might be limitations on the length of a single slab (also referred to as coils, coil slab, etc.) of a microchannel heat exchanger, especially a two-pass or multi-pass heat exchanger. In an example, the maximum length a single slab of a microchannel heat exchanger can be at or about 1.7 meters due to the manufacturing and/or production constraints, which is still relatively long compared with other refrigerant systems. In some applications, even a single slab with the maximum length is not long enough to meet the user's requirements (e.g., capacity requirements). In an embodiment, two or more slabs (of the same/similar length to optimize the refrigerant/fluid distribution) are used in a heat exchanger. In such embodiment, each slab can have a length of at or about one meter, or at or about the maximum length (e.g., 1.7 meters), or any suitable length. In an embodiment, an oversized microchannel heat exchanger is needed in a refrigeration circuit to meet the user's requirements (e.g., capacity requirements), by e.g., deploying multi-slab to achieve needed face area. In an embodiment, the scale of the refrigeration circuit capacity can be, for example, under 12.5 tons (e.g., at or about 4 tons in a part load mode). In an embodiment, the scale of the refrigeration circuit capacity (e.g., nominal capacity) can be, for example, at or over 12.5 tons. In another embodiment, the scale of the refrigeration circuit capacity (e.g., nominal capacity) can be, for example, at or over 25 tons. In yet another embodiment, the scale of the refrigeration circuit capacity (e.g., nominal capacity) can be, for example, from at or about 12.5 tons to at or about 25 tons.

In an embodiment, a multi-slab microchannel heat exchanger can be used in a refrigeration circuit such as, for example, in a heating, ventilation, air conditioning, and refrigeration (HVACR) system. In an embodiment, an HVACR system can be a rooftop unit or a heat pump air-conditioning unit in a unitary system (which combines heating, cooling, and/or fan sections in one or a few assemblies for simplified application and installation). In an embodiment, the multi-slab microchannel heat exchanger can be can be an evaporator. In an embodiment, the multi-slab microchannel heat exchanger can be a condenser.

In an embodiment, a slab of a multi-slab microchannel heat exchanger includes a plurality of flat tubes arranged successively in a direction along a length of the multi-slab microchannel heat exchanger. Each of the plurality of flat tubes has microchannels or small pathways for refrigerant (e.g., gas and/or liquid) to pass through. The microchannels have inlets and outlets. The multi-slab microchannel heat exchanger includes an inlet header that is in communication with the inlet of each of the plurality of flat tubes. The multi-slab microchannel heat exchanger further includes an outlet header that is in communication with the outlet of each of the plurality of flat tubes. In an embodiment, the inlet header and/or the outlet header fixedly connect to the plurality of flat tubes of the multi-slab microchannel heat exchanger.

Embodiments disclosed herein are directed to distribution/routing of heat transfer fluid (e.g., refrigerant or the like) flow to a multi-slab microchannel heat exchanger, preferably all from a local point (also referred to as a near side, the side of the heat exchanger where maintenance or service process can be readily performed) of connection. In an embodiment, the multi-slab microchannel heat exchanger is a single or independent component in a refrigeration circuit.

FIG. 1 is a schematic diagram of a refrigeration circuit 100, according to an embodiment. The refrigeration circuit 100 generally includes a compressor 120, a condenser 140, an expansion device 160, and an evaporator 180. In an embodiment, the evaporator 180 can be a multi-slab microchannel heat exchanger. In another embodiment, the condenser 140 can be a multi-slab microchannel heat exchanger. The refrigeration circuit 100 is an example and can be modified to include additional components. For example, in an embodiment, the refrigeration circuit 100 can include other components such as, but not limited to, an economizer heat exchanger, one or more flow control devices, a receiver tank, a dryer, a suction-liquid heat exchanger, or the like.

The refrigeration circuit 100 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like. In an embodiment, an HVACR system can be a rooftop unit or a heat pump air-conditioning unit.

The compressor 120, condenser 140, expansion device 160, and evaporator 180 are fluidly connected. In an embodiment, the refrigeration circuit 100 can be configured to be a cooling system (e.g., an air conditioning system) capable of operating in a cooling mode. In an embodiment, the refrigeration circuit 100 can be configured to be a heat pump system that can operate in both a cooling mode and a heating/defrost mode.

The refrigeration circuit 100 can operate according to generally known principles. The refrigeration circuit 100 can be configured to heat or cool a liquid process fluid (e.g., a heat transfer fluid or medium (e.g., a liquid such as, but not limited to, water or the like)), in which case the refrigeration circuit 100 may be generally representative of a liquid chiller system. The refrigeration circuit 100 can alternatively be configured to heat or cool a gaseous process fluid (e.g., a heat transfer medium or fluid (e.g., a gas such as, but not limited to, air or the like)), in which case the refrigeration circuit 100 may be generally representative of an air conditioner or heat pump.

In operation, the compressor 120 compresses a working fluid (e.g., a heat transfer fluid (e.g., refrigerant or the like)) from a relatively lower pressure gas to a relatively higher-pressure gas. The relatively higher-pressure gas is also at a relatively higher temperature, which is discharged from the compressor 120 and flows through the condenser 140. In accordance with generally known principles, the working fluid flows through the condenser 100 and rejects heat to the process fluid (e.g., water, air, etc.), thereby cooling the working fluid. The cooled working fluid, which is now in a liquid form, flows to the expansion device 160. The expansion device 160 can be but is not limited to for example an expansion valve, orifice, expander, or the like. The expansion device 160 reduces the pressure of the working fluid. As a result, a portion of the working fluid is converted to a gaseous form. The working fluid, which is now in a mixed liquid and gaseous form flows to the evaporator 180. The working fluid flows through the evaporator 180 and absorbs heat from the process fluid (e.g., a heat transfer medium (e.g., water, air, etc.)), heating the working fluid, and converting it to a gaseous form. The gaseous working fluid then returns to the compressor 120. The above-described process continues while the refrigeration circuit is operating, for example, in a cooling mode (e.g., while the compressor 120 is enabled).

Figure 2A:
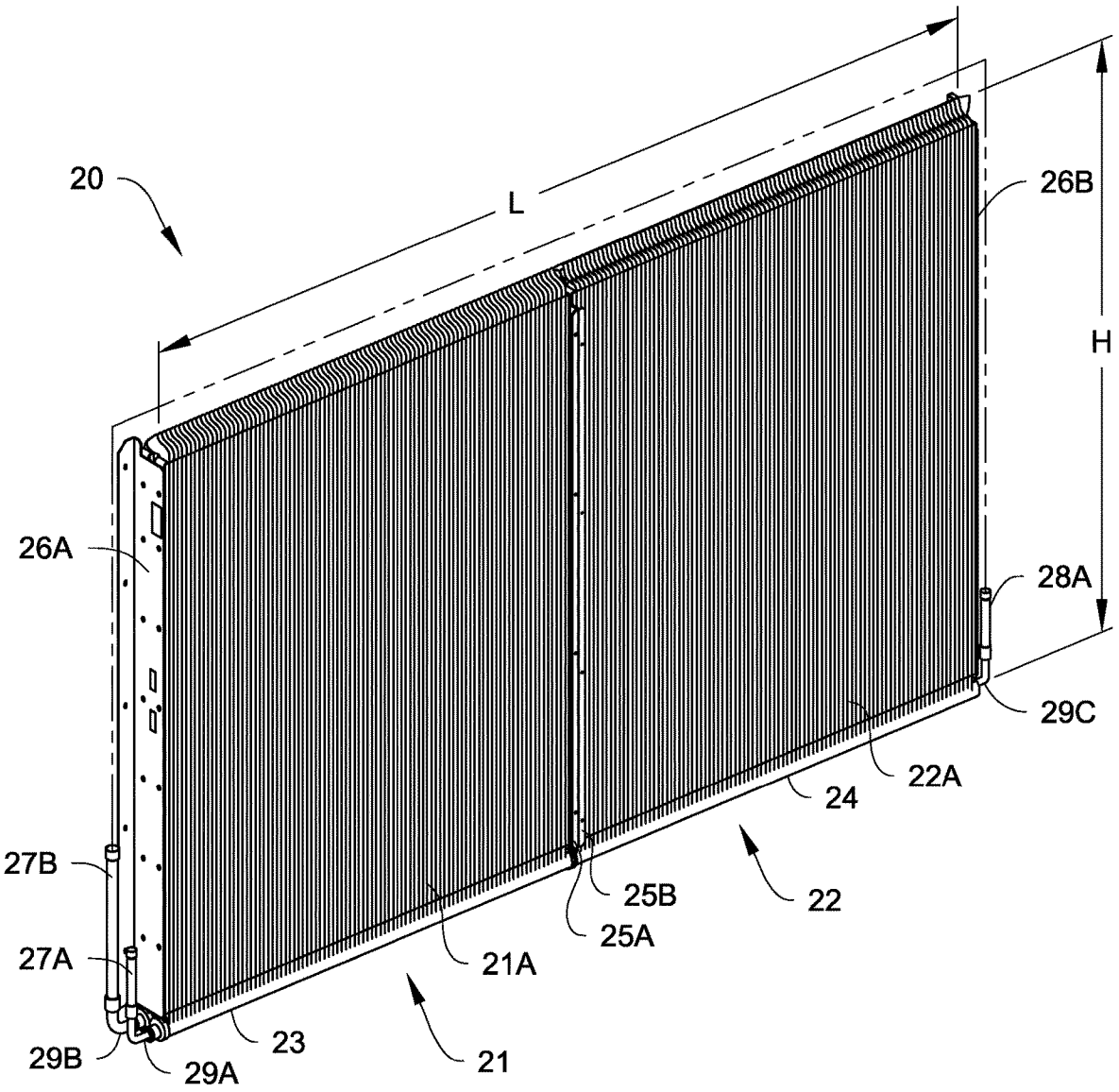
FIG. 2A is a perspective view of a multi-slab microchannel heat exchanger, according to an embodiment.

FIG. 2A is a perspective view of a multi-slab microchannel heat exchanger 20, according to an embodiment. The multi-slab microchannel heat exchanger 20 includes a slab 21 and a slab 22. The slab 21 includes a plurality of microchannel tubes 21A. In an embodiment, the tubes can be flat multiport tubes. The slab 21 also includes an inlet header 23 and an outlet header (behind the inlet header 23). An inlet conduit (e.g., pipe) 27A is connected to the inlet header 23 via an inlet connector 29A. An outlet conduit (e.g., pipe) 27B is connected to the outlet header of the slab 21 via an outlet connector 29B. In an embodiment, the inlet header 23, the outlet header of the slab 21, the inlet connector 29A, and outlet connector 29B are made of aluminum or aluminum alloys. In an embodiment, the inlet pipe 27A and the outlet pipe 27B are made of copper or copper alloys. It will be appreciated that the copper-aluminum transition joints (where the inlet pipe 27A and the inlet connector 29A converge and where the outlet pipe 27B and the outlet connector 29B converge) are protected or covered from corrosion (to prevent copper ions contained within the condensate to reach the aluminum part of the heat exchanger due to corrosion concerns).

The slab 21 also includes a bracket 25A. In an embodiment, the bracket 25A can be a flat plate made of aluminum or aluminum alloys extended in a height (H) direction of the heat exchanger 20. The bracket 25A is fixed to the last tube (the tube at the right end of the slab 21 in a length (L) direction of the slab 21, which can be a reinforcement tube) of the slab 21. The slab 21 further includes an end support 26A. The end support 26A can be a flat plate extended in the height (H) direction of the heat exchanger 20. The end support 26A is fixed to the first tube (the tube at the left end of the slab 21 in the length (L) direction of the slab 21, which can be a reinforcement tube) of the slab 21. The differences between the end support 26A and the bracket 25A include: (1) the end support 26A is at an end of the heat exchanger 20 in the length (L) direction of the heat exchanger 20 while the bracket 25A is between the slabs 21 and 22. For example, the bracket 25A can be in the middle of the heat exchanger 20; (2) the bracket 25A includes joint assembly (e.g., bolt(s) and nut(s)) to fixedly connect to another bracket 25B of the slab 22 while the end support 26A has an L-shape (see 230A in FIG. 2B) and has joint assembly to fixedly connect the heat exchanger 20 to the refrigeration circuit since the end support 26A is at the end of the heat exchanger 20; and (3) the end support 26A can have a thickness (in the length (L) direction of the heat exchanger 20) greater than a thickness of the bracket 25A to serve as a part of a frame of the heat exchanger 20.

The slab 22 and the slab 21 are mirror images (from the reference point at brackets 25A, 25B) of each other. The slab 22 includes a bracket 25B (which can be made of aluminum or aluminum alloys), a plurality of microchannel tubes 22A, an inlet header 24, an end support 26B, and an outlet header (behind the inlet header 24). An inlet conduit (e.g., pipe) 28A is connected to the inlet header 24 via an inlet connector 29C. An outlet conduit (e.g., pipe, behind inlet pipe 28A) of the slab 22 is connected to the outlet header of the slab 22 via an outlet connector (behind the inlet connector 29C). In an embodiment, the components of the slab 22 are the same as or similar to the structures and/or functions and/or materials of the components of the slab 21. The end supports 26A, 26B can be made of aluminum or aluminum alloys. The slab 21 and the slab 22 converge at a middle point (at the location of brackets 25A, 25B) of the heat exchanger 20.

The embodiment disclosed in FIG. 2A can put the refrigerant connections on a near (left) side and a far (right) side of the heat changer 20 (leaving the refrigerant connections on the outer edges of the heat exchanger 20), and may cause issues in a production or service or maintenance environment. Copper piping (see dotted lines in FIG. 2A) may be utilized to span the required distance to bring the far side refrigerant connection to the near side to allow refrigerant to flow to the slabs on both sides. For example, copper piping can route refrigerant to inlet pipes 27A and 28A via, e.g., a common inlet conduit (e.g., pipe). Copper piping can also route refrigerant from the outlet pipe 27B and the outlet pipe of the slab 22 to, e.g., a common outlet conduit (e.g., pipe). The copper piping needs to be isolated/insulated as to not allow copper ions contained within the condensate to reach the aluminum of the heat exchanger 20 due to corrosion concerns. That is, the copper piping needs to be insulated to ensure no condensate can fall from the copper piping (onto the aluminum heat exchanger slabs) carrying copper ions that could corrode the heat exchanger. The entire process (production or service or maintenance) can be labor intensive and costly.

Figure 2B:
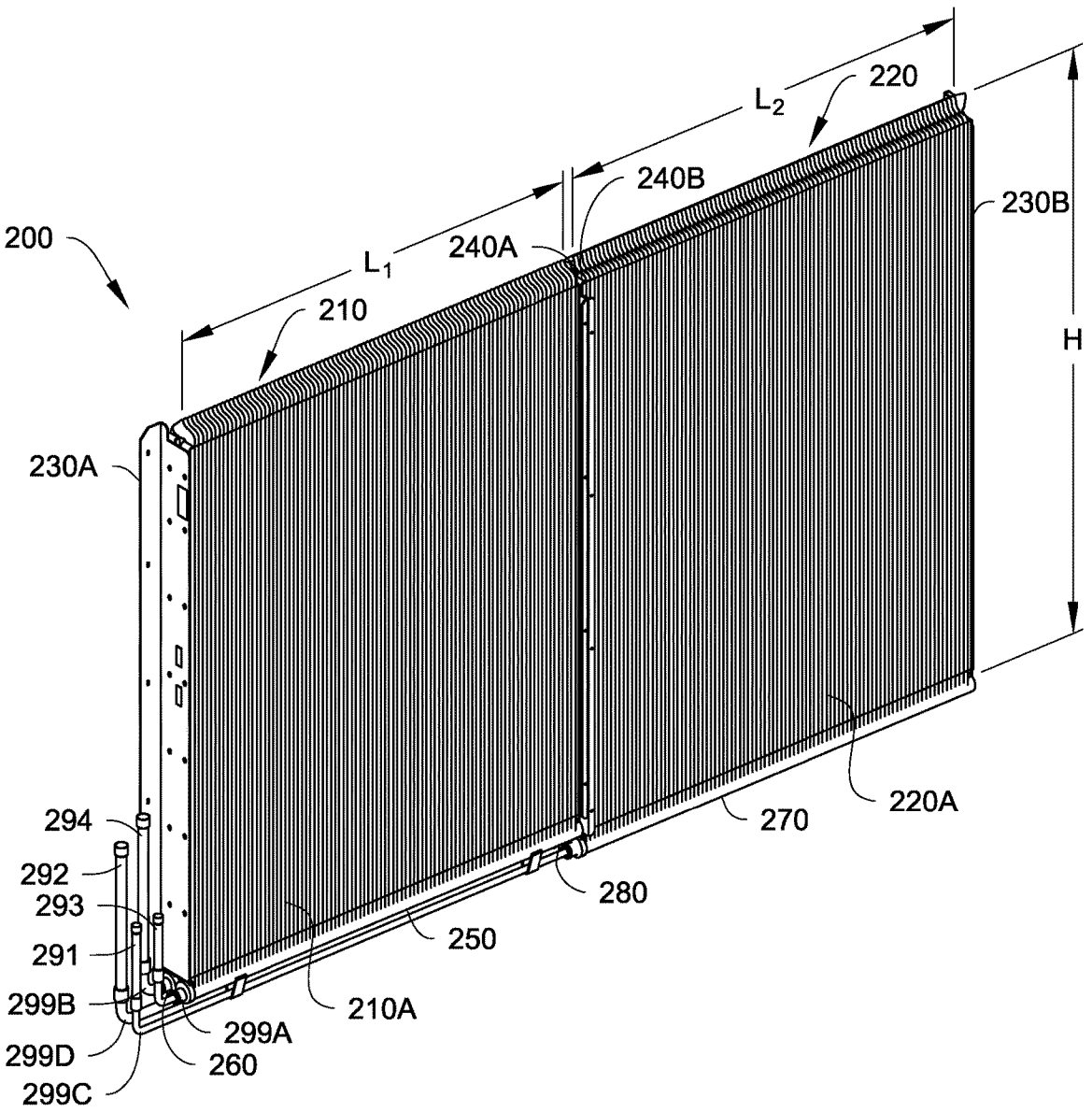
FIG. 2B is a perspective view of a multi-slab microchannel heat exchanger, according to another embodiment.
Figure 2C:
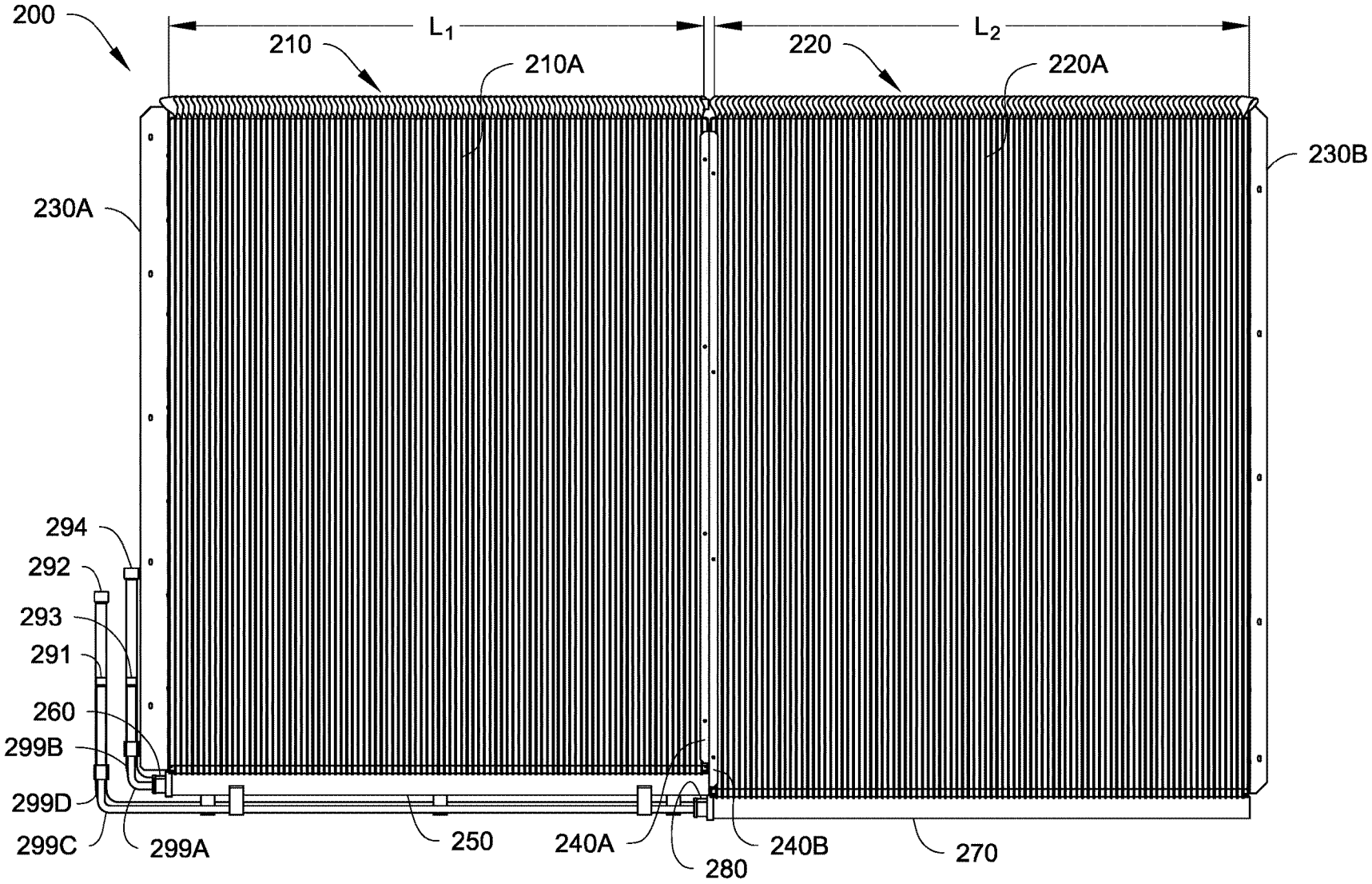
FIG. 2C is a front view of a multi-slab microchannel heat exchanger, according to an embodiment.

FIG. 2B is a perspective view of a multi-slab microchannel heat exchanger 200, according to another embodiment. FIG. 2C is a front view of the multi-slab microchannel heat exchanger 200, according to an embodiment.

The multi-slab microchannel heat exchanger 200 includes a slab 210 and a slab 220. The slab 210 includes a plurality of microchannel tubes 210A (see also FIGS. 2D and 3). In an embodiment, the tubes 210A can be flat multiport tubes extending in a height (H) direction of the heat exchanger 200. The plurality of tubes of the slab 210 is arranged successively in a direction along a length (L1) of the heat exchanger 200. The slab 210 also includes an inlet header 250 and an outlet header 260.

An inlet conduit (e.g., pipe) 293 is connected to the inlet header 250 via an inlet connector 299A. An outlet conduit (e.g., pipe) 294 is connected to the outlet header 260 via an outlet connector 299B. In an embodiment, the inlet pipe 293 and the outlet pipe 294 extend in a vertical direction along a height (H) direction of the heat exchanger 200. The inlet connector 299A and the outlet connector 299B are disposed at the left end of the heat exchanger 200. In one embodiment, the inlet connector 299A can extend (from the connection with the inlet pipe 293) vertically in the height (H) direction and then bend and then extend horizontally in the length (L1) direction to connect to the inlet header 250. In one embodiment, the outlet connector 299B can extend (from the connection with the outlet pipe 294) vertically in the height (H) direction and then bend and then extend horizontally in the length (L1) direction to connect to the outlet header 260. In one embodiment, L1 is equal to L2. In another embodiment, L1 is not equal to L2.

The heat exchanger 200 as illustrated in FIG. 2B can be a two-pass heat exchanger. In operation, heat transfer fluid (e.g., refrigerant or the like) flows through into the inlet pipe 293, into the inlet header 250 via the inlet connector 299A, into and through the plurality of microchannel tubes of the slab 210 first upwardly from a bottom to a top of the heat exchanger 200 in the height (H) direction and then downwardly from the top to the bottom of the heat exchanger 200 in the height (H) direction, into the outlet header 260, and then into the outlet pipe 294 via the outlet connector 299B.

In operation, heat transfer fluid (e.g., refrigerant or the like) flows through into the inlet pipe 293, into the inlet header 250 via the inlet connector 299A, into and through the plurality of microchannel tubes 210A of the slab 210 first upwardly from a bottom to a top of the heat exchanger 200 in the height (H) direction and then downwardly from the top to the bottom of the heat exchanger 200 in the height (H) direction, into the outlet header 260, and then into the outlet pipe 294 via the outlet connector 299B.

Each of the inlet header 250 and the outlet header 260 has a length L1 (the length of the slab 210), extends from the left end of the slab 210 to the right end of the slab 210 in the length direction of the heat exchanger 200, and is located at the bottom of the heat exchanger 200.

In an embodiment, the inlet header 250, the outlet header 260, the inlet connector 299A, and outlet connector 299B are made of aluminum or aluminum alloys. In an embodiment, the inlet pipe 293 and the outlet pipe 294 are made of copper or copper alloys. It will be appreciated that the copper-aluminum transition joints (where the inlet pipe 293 and the inlet connector 299A converge and where the outlet pipe 294 and the outlet connector 299B converge) are protected or covered from corrosion (to prevent copper ions contained within the condensate to reach the aluminum part of the heat exchanger 200 due to corrosion concerns).

The slab 210 also includes a bracket 240A. In an embodiment, the bracket 240A can be a flat plate made of aluminum or aluminum alloys, extending vertically from a top to a bottom of the heat exchanger 200 in the height (H) direction of the heat exchanger 200. The bracket 240A is fixed to the last tube (the tube at the right end of the slab 210 in a length (L1) direction of the slab 210, which can be a reinforcement tube for attachment purpose) of the slab 210. The slab 210 further includes an end support 230A. The end support 230A can be a flat plate extending vertically from a top to a bottom of the heat exchanger 200 in the height (H) direction of the heat exchanger 200. The end support 230A is fixed to the first tube (the tube at the left end of the slab 210 in the length (L) direction of the slab 210, which can be a reinforcement tube for attachment purpose) of the slab 210. The differences between the end support 230A and the bracket 240A include: (1) the end support 230A is at an end of the heat exchanger 200 in a length (L) direction of the heat exchanger 200 while the bracket 240A is at an end of the slab 210 and between the slab 210 and slab 220, for example the bracket 240A can be in the middle of the heat exchanger 200; (2) the bracket 240A includes joint assembly (e.g., bolt(s) and nut(s)) to fixedly connect to another bracket (e.g., 240B on slab 220) while the end support 230A has an L-shape and has joint assembly to fixedly connect the heat exchanger 200 to the refrigeration circuit since the end support 230A is at the end of the heat exchanger 200; and (3) the end support 230A can have a thickness (in the length (L1) direction of the slab 210) greater than a thickness of the bracket 240A so that the end support 230A can serve as a part of a frame of the heat exchanger 200.

Figure 2D:
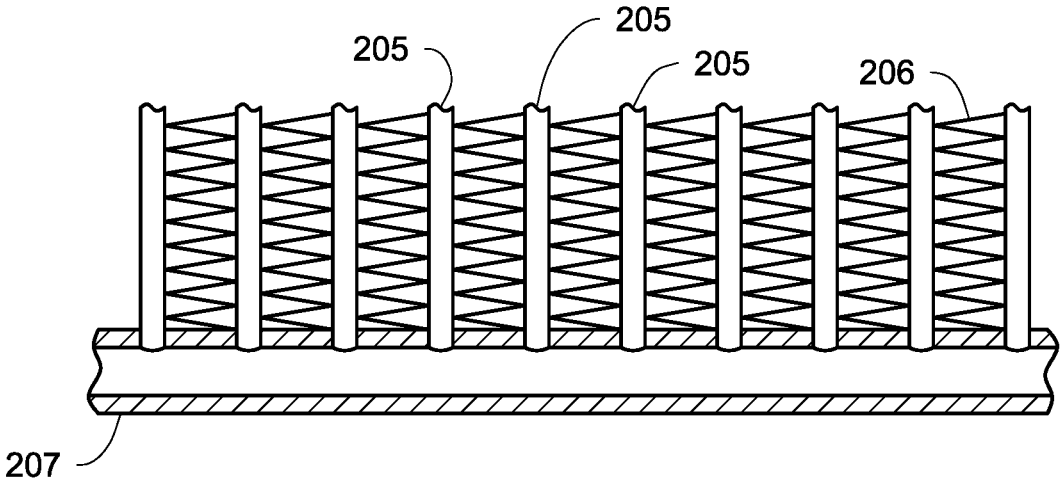
FIG. 2D is a side sectional view of a plurality of microchannel tubes in fluid communication with a header, according to an embodiment.
Figure 3:
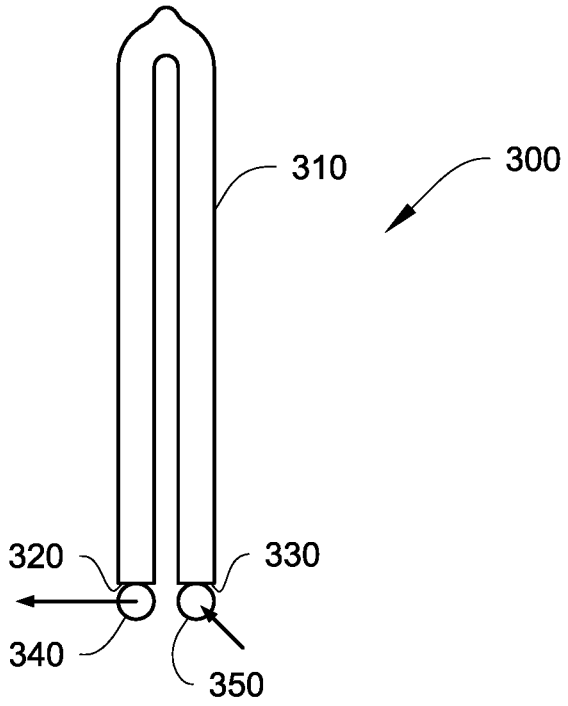
FIG. 3 is a diagrammatic view of a slab of a multi-slab microchannel heat exchanger, according to an embodiment.

The slab 220 includes a plurality of microchannel tubes 220A (see also FIGS. 2D and 3). In an embodiment, the tubes can be flat multiport tubes extending in a height (H) direction of the heat exchanger 200. The plurality of tubes of the slab 220 is arranged successively in a direction along a length (L2) of the heat exchanger 200. The slab 220 also includes an inlet header 270 and an outlet header 280.

An inlet conduit (e.g., pipe) 291 is connected to the inlet header 270 via an inlet connector 299C. An outlet conduit (e.g., pipe) 292 is connected to the outlet header 280 via an outlet connector 299D. In an embodiment, the inlet pipe 291 and the outlet pipe 292 extend in a vertical direction along a height direction of the heat exchanger 200. The inlet connector 299C and the outlet connector 299D are disposed at the left end of the heat exchanger 200. In one embodiment, the inlet connector 299C can extend (from the connection with the inlet pipe 291) vertically in the height (H) direction and then bend and then extend horizontally in the length (L2) direction to connect to the inlet header 270. In one embodiment, the outlet connector 299D can extend (from the connection with the outlet pipe 292) vertically in the height (H) direction and then bend and then extend horizontally in the length (L2) direction to connect to the outlet header 280. In an embodiment, the inlet connector 299C and the outlet connector 299D can extend a length L1 in the longitudinal direction (parallel to the inlet/outlet headers) of the heat exchanger 200 and fluidly connect to the inlet header 270 and the outlet header 280 (at a location in the middle of the heat exchanger 200 in the length direction), respectively.

In operation, heat transfer fluid (e.g., refrigerant or the like) flows through into the inlet pipe 291, into the inlet header 270 via the inlet connector 299C, into and through the plurality of microchannel tubes 220A of the slab 220 first upwardly from a bottom to a top of the heat exchanger 200 in the height (H) direction and then downwardly from the top to the bottom of the heat exchanger 200 in the height (H) direction, into the outlet header 280, and then into the outlet pipe 293 via the outlet connector 299D.

A common inlet conduit (e.g., pipe) can route refrigerant (from, e.g., an expansion device or a compressor) to the inlet pipes 291 and 293, and a common outlet conduit (e.g., pipe) can route refrigerant from the outlet pipes 292 and 294 (to e.g., a compressor or an expansion device of the refrigeration circuit).

Each of the inlet header 270 and the outlet header 280 has a length L2 (the length of the slab 210), extends from the left end of the slab 220 to the right end of the slab 220 in the length direction of the heat exchanger 200, and is located at the bottom of the heat exchanger 200.

In an embodiment, the inlet header 270, the outlet header 280, the inlet connector 299C, and outlet connector 299D are made of aluminum or aluminum alloys. In an embodiment, the inlet pipe 291 and the outlet pipe 292 are made of copper or copper alloys. It will be appreciated that the copper-aluminum transition joints (where the inlet pipe 291 and the inlet connector 299C converge and where the outlet pipe 292 and the outlet connector 299D converge) are protected or covered from corrosion (to prevent copper ions contained within the condensate to reach the aluminum part of the heat exchanger 200 due to corrosion concerns).

It will be appreciated that disposing the inlet/outlet connecters/headers or the piping of the inlet/outlet connecters/headers under the slab(s) (at the bottom of the slab(s)), and/or making the inlet/outlet connecters/headers or the piping of the inlet/outlet connecters/headers using aluminum or aluminum alloys can help with reducing/eliminating corrosion (to prevent copper ions contained within the condensate to reach the aluminum part of the heat exchanger due to corrosion concerns). The inlet/outlet connecters or the piping of the inlet/outlet connecters can be fixedly connected to the inlet/outlet pipe(s) and/or the inlet/outlet headers by various means of attachment, including straps and post-process welding, blocks of aluminum either welded or strapped, or plastic wire ties, etc.

The slab 220 also includes a bracket 240B. In an embodiment, the bracket 240B can be a flat plate made of aluminum or aluminum alloys, extending vertically from a top to a bottom of the heat exchanger 200 in the height (H) direction of the heat exchanger 200. The bracket 240B is fixed to the first tube (the tube at the left end of the slab 220 in the length (L2) direction of the slab 220, which can be a reinforcement tube for attachment purpose) of the slab 220. The slab 220 further includes an end support 230B. The end support 230B can be a flat plate extending vertically from a top to a bottom of the heat exchanger 200 in the height direction of the heat exchanger 200. The end support 230B is fixed to the last tube (the tube at the right end of the slab 220 in the length (L2) direction of the slab 220, which can be a reinforcement tube for attachment purpose) of the slab 220. The differences between the end support 230B and the bracket 240B include: (1) the end support 230B is at an end of the heat exchanger 200 in a longitudinal direction of the heat exchanger 200 while the bracket 240B is at an end of the slab 220 and between the slab 210 and 220, for example the bracket 240B can be in the middle of the heat exchanger 200; (2) the bracket 240B includes joint assembly (e.g., bolt(s) and nut(s)) to fixedly connect to another bracket (e.g., 240A of the slab 210) while the end support 230B has an L-shape and has joint assembly to fixedly connect the heat exchanger 200 to the refrigeration circuit since the end support 230B is at the end of the heat exchanger 200; and (3) the end support 230B can have a thickness (in the length (L2) direction) greater than a thickness of the bracket 240B so that the end support 230B can serve as a part of a frame of the heat exchanger 200. The slab 210 and the slab 220 converge at a middle point (at the location of brackets 240A, 240B) of the heat exchanger 200.

It will be appreciated that when there are more than two slabs, and all the slabs are arranged successively in the direction along the length (L1, L2) of the heat exchanger, each slab at the two ends (in the longitudinal direction) of the heat exchanger has an end support at one end of the slab and a bracket at the other end of the slab, and each slab in the middle of the heat exchanger has a bracket at one end of the slab and another bracket at the other end of the slab.

In an embodiment, the inlet connectors and the outlet connectors of the plurality of slabs of the heat exchanger are disposed at a same/single end of the heat exchanger. In an embodiment, the inlet connectors and the outlet connectors of the plurality of slabs of the heat exchanger are disposed at a bottom of the same/single end of the heat exchanger. In an embodiment, the inlet pipes, the outlet pipes, the inlet connectors, and the outlet connectors of the plurality of slabs of the heat exchanger are disposed at the same/single end of the heat exchanger. In an embodiment, the inlet headers and the outlet headers of the plurality of slabs of the heat exchanger are disposed at the bottom of the heat exchanger.

FIG. 2D is a side sectional view of a plurality of micro-channel tubes 205 in fluid communication with a header 207, according to an embodiment. The adjacent tubes 205 generally have fan-fold fins 206 brazed in between. Refrigerant can be distributed into the microchannel tubes 205 from the header 207, or into the header 207 from micro-channel tubes 205. Outer surfaces of the micro-channel tubes 205 and the fins 206 may help heat exchange between the refrigerant (working fluid) in the micro-channel tubes 205 and the environment (e.g., process fluid such as air or water). It will be appreciated that the header 207 can be the inlet header or the outlet header described in FIGS. 2A-2C and 3-6. It will also be appreciated that the microchannel tubes 205 can be the microchannel tubes described in FIGS. 2A-2C and 3-6.

FIG. 3 is a diagrammatic view of a slab (see 210 and 220 of FIG. 2B) 300 of a multi-slab microchannel heat exchanger, according to an embodiment. As illustrated in FIG. 3, an inlet header 350 of the heat exchanger is in fluid communication with the inlet 330 of each tube 310 of the plurality of tubes of the slab 300. An outlet header 340 of the heat exchanger is in fluid communication with the outlet 320 of each tube 310 of the plurality of tubes of the slab 300. The tube 310 has microchannels or small pathways for gas or liquid (e.g., refrigerant) to pass through. The microchannels have inlets and outlets. The inlet 330 of each tube 310 of the plurality of tubes is in fluid communication with the outlet 320 of each tube 310 of the plurality of tubes through the microchannels of the tube 310.

Figure 4:
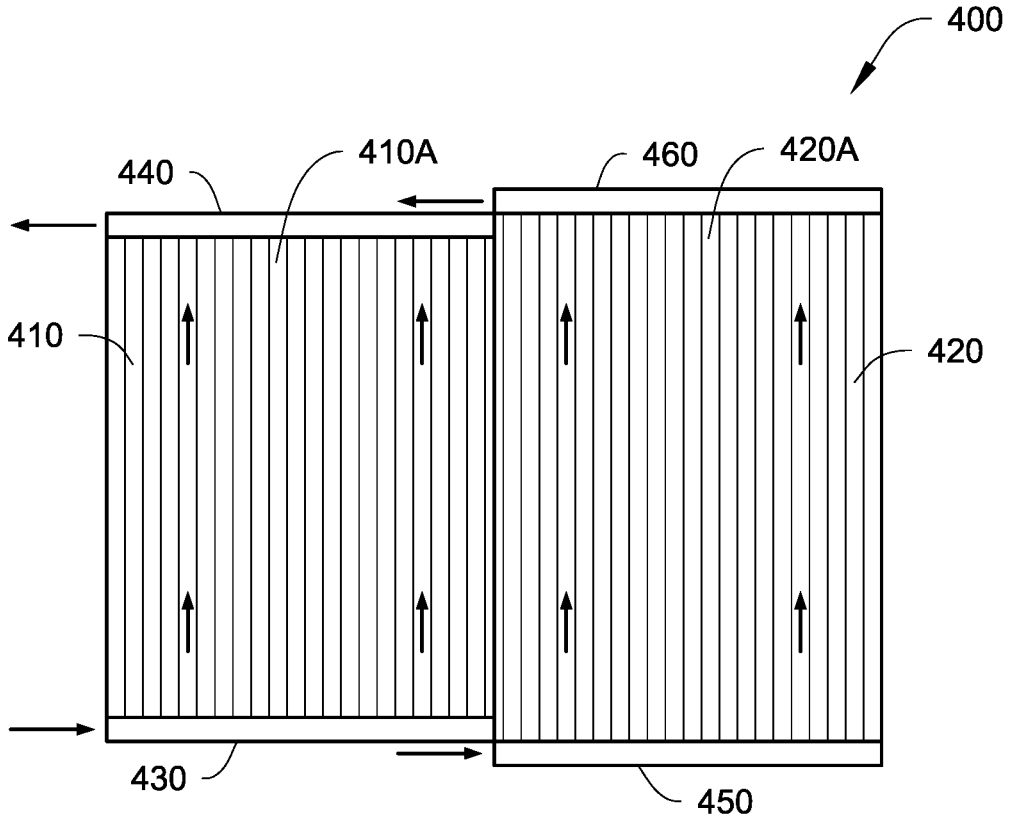
FIG. 4 is a structural schematic diagram of a multi-slab microchannel heat exchanger, according to an embodiment.

FIG. 4 is a structural schematic diagram of a multi-slab microchannel heat exchanger 400, according to an embodiment. The heat exchanger 400 includes a slab 410 having a plurality of microchannel tubes 410A, an inlet header 430, and an outlet header 440; and a slab 420 having a plurality of microchannel tubes 420A, an inlet header 450 and an outlet header 460. The heat exchanger 400 is a single pass heat exchanger. The arrows indicate the direction of the flow of the heat transfer fluid. The inlet/outlet pipes and the inlet/outlet connectors are not shown. It will be appreciated that the heat exchanger 400 of FIG. 4 can have the same/similar components as the heat exchanger 200 of FIG. 2C, except that the heat exchanger 400 is a single pass heat exchanger while the heat exchanger 200 is a two-pass heat exchanger. It will also be appreciated that in FIG. 4, the inlet pipes and the inlet connectors can have the same/similar configuration as the outlet pipes and the outlet connectors, except that the inlet pipes and the inlet connectors are disposed at the bottom of the heat exchanger 400 while the outlet pipes and the outlet connectors are disposed at the top of the heat exchanger 400 or vice versa.

Figure 5:
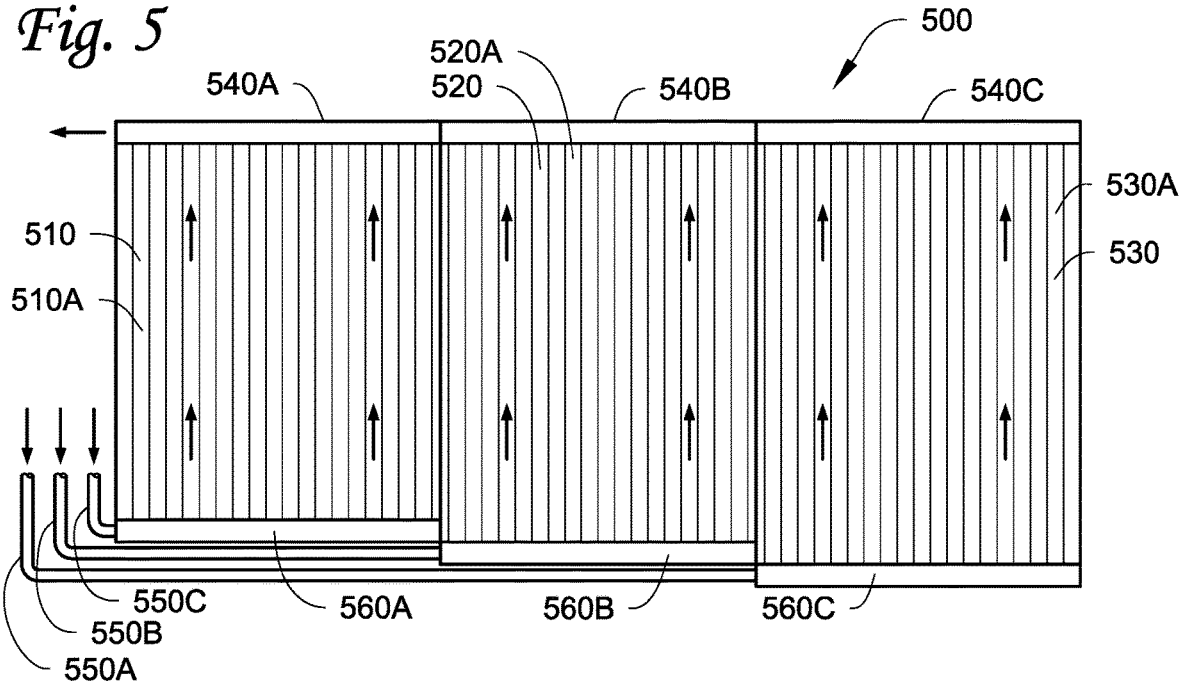
FIG. 5 is a structural schematic diagram of a multi-slab microchannel heat exchanger, according to another embodiment.

FIG. 5 is a structural schematic diagram of a multi-slab microchannel heat exchanger 500, according to another embodiment. The heat exchanger 500 includes a slab 510 having a plurality of microchannel tubes 510A, an inlet header 560A, and an outlet header 540A; a slab 520 having a plurality of microchannel tubes 520A, an inlet header 560B, and an outlet header 540B; and a slab 530 having a plurality of microchannel tubes 530A, an inlet header 560C, and an outlet header 540C. The heat exchanger 500 also includes inlet connectors 550A, 550B, 550C fluidly connected to the inlet headers 560C, 560B, and 560A, respectively. The inlet connectors 550A, 550B, 550C can have the same/similar configuration as the inlet connectors 299A, 299C of FIG. 2C. The outlet pipe (not shown) and the outlet connector (not shown) of FIG. 5 can have the same/similar configuration as the outlet pipes 292, 294 of FIG. 2C and the outlet connectors 299B, 299D of FIG. 2C. The heat exchanger 500 is a single pass heat exchanger. The arrows indicate the direction of the flow of the heat transfer fluid.

Figure 6:
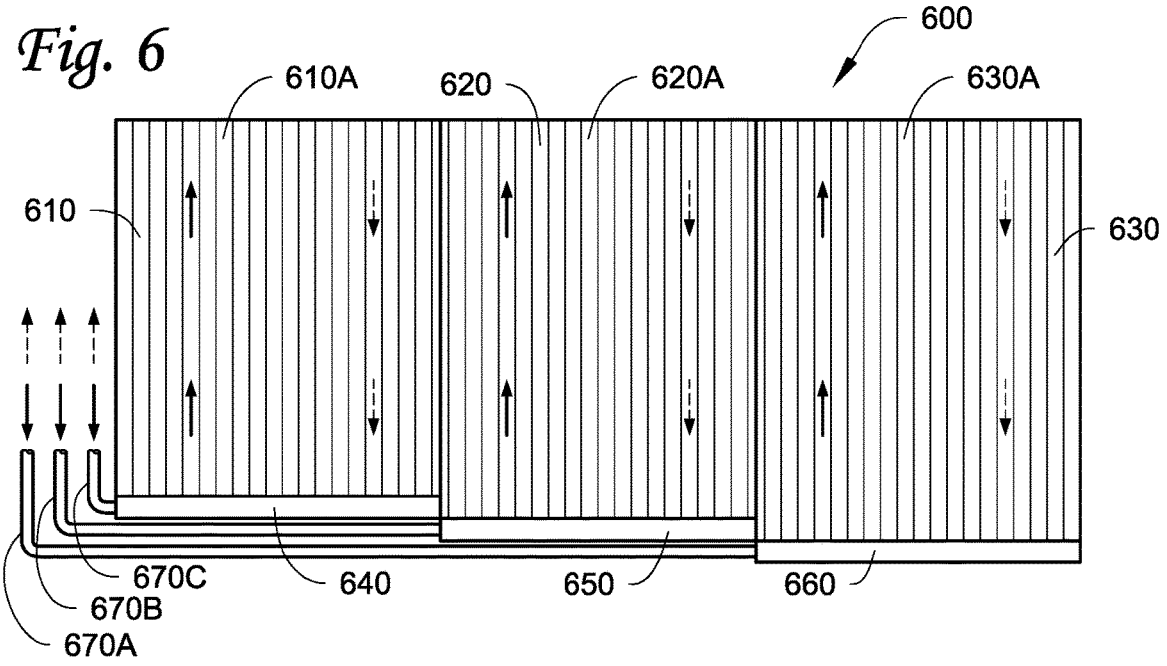
FIG. 6 is a structural schematic diagram of a multi-slab microchannel heat exchanger, according to yet another embodiment.

FIG. 6 is a structural schematic diagram of a multi-slab microchannel heat exchanger 600, according to yet another embodiment. The heat exchanger 600 includes a slab 610 having a plurality of microchannel tubes 610A and an inlet header 640 and an outlet header (behind the inlet header 640), a slab 620 having a plurality of microchannel tubes 620A and an inlet header 650 and an outlet header (behind the inlet header 650), and a slab 630 having a plurality of microchannel tubes 630A and an inlet header 660 and an outlet header (behind the inlet header 660). The heat exchanger 600 also includes inlet connectors 670C, 670B, and 670A fluidly connected to the inlet headers 640, 650, and 660, respectively. The outlet connectors are not shown. The components of the heat exchanger 600 are the same as or similar to the components disclosed in FIGS. 2B and 2C. For example, the inlet connectors 670A, 670B, and 670C can have the same/similar configuration as the inlet connectors 299A, 299C of FIG. 2C. The outlet connectors of FIG. 6 can have the same/similar configuration as the outlet connectors 299B, 299D of FIG. 2C. The arrows (solid arrow: in, dotted arrow: out) indicate the direction of the flow of the heat transfer fluid. The heat exchanger 600 is a two-pass heat exchanger. It will be appreciated that FIG. 6 can have the same/similar components as FIG. 2C, except that FIG. 6 has three slabs while FIG. 2C has two slabs. It will also be appreciated that FIG. 6 can have the same/similar components as FIG. 5, except that the heat exchanger 500 is a single pass heat exchanger while the heat exchanger 600 is a two-pass heat exchanger.

Figure 7:
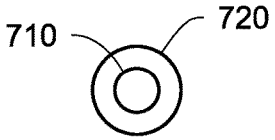
FIG. 7 is a schematic sectional view of concentric conduits, according to an embodiment.

FIG. 7 is a schematic sectional view of concentric conduits 710, 720, according to an embodiment. The conduit 710 is disposed inside the conduit 720. In an embodiment, the conduit 710 extends/runs concentric with the conduit 720.

In an embodiment, the conduit 710 can be an inlet connector (e.g., the far side inlet connector 299C of FIG. 2B), and the conduit 720 can be an inlet header (e.g., the near side inlet header 250 of FIG. 2B). In an embodiment, the conduit 710 can be an outlet connector (e.g., the far side outlet connector 299D of FIG. 2B), and the conduit 720 can be an outlet header (e.g., the near side outlet header 260 of FIG. 2B).

In an embodiment, the conduit 710 can be an inlet connector (e.g., the far side inlet connector 299C of FIG. 2B), and the conduit 720 can be an outlet connector (e.g., the far side outlet connector 299D of FIG. 2B). In an embodiment, the conduit 710 can be an outlet connector (e.g., the far side outlet connector 299D of FIG. 2B), and the conduit 720 can be an inlet connector (e.g., the far side inlet connector 299C of FIG. 2B). These embodiments can also be referred to as being arranged in an "internal heat exchanger" (e.g., exchanging heat between the inlet two-phase pipe/line and the outlet vapor pipe/line when one pipe/line is disposed inside the other pipe/line) fashion.

Testing shows that with the addition of an internal heat exchanger in the connecting lines/pipes of a slab of the multi-slab microchannel heat exchanger, the performance of the refrigeration circuit can be improved/enhanced by at or about 2%.

Figure 8:
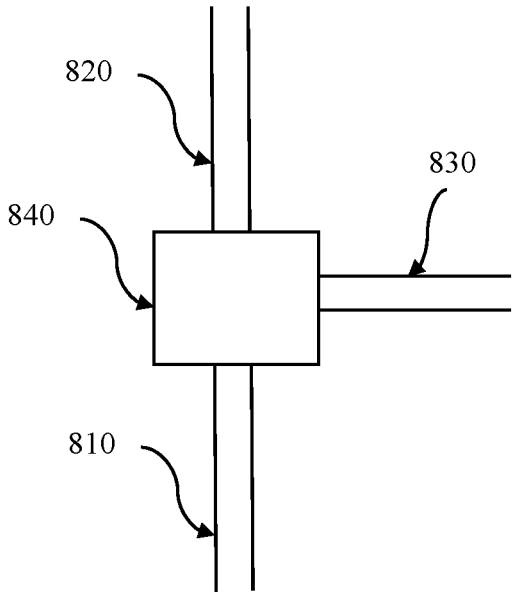
FIG. 8 is a schematic diagram of a first conduit and a second conduit fluidly connected to a common conduit, according to an embodiment.

FIG. 8 is a schematic diagram of a first conduit 810 and a second conduit 820 fluidly connected to a common conduit 830, according to an embodiment. As shown in FIG. 8, the first conduit 810 (inlet conduit or outlet conduit) and the second conduit 820 (inlet conduit or outlet conduit) are fluidly connected to the common conduit 830 (common inlet conduit or common outlet conduit) via any suitable connection (e.g., a T-shaped connector or the like) 840.

Embodiments disclosed herein meet a long-felt but unsatisfied need of reducing manufacturing and maintenance/service cost, reducing physical labor burden, and mitigating corrosion concerns of copper ions in condensate falling on aluminum, in an oversized/multi-slab microchannel heat exchanger.

It will be appreciated that typically in manufacturing an oversized/multi-slab microchannel heat exchanger, there was a need for additional copper piping to be routed around the heat exchanger for a far side refrigeration connection as well as the insulation of this copper piping from the aluminum (to avoid corrosion). It will also be appreciated that the additional copper piping was used because there is no good method to fix/join aluminum piping, aluminum piping tends to move easily (not stable), etc. Embodiments disclosed herein allow all refrigerant line connections to be made in a production environment to be on a single side of the heat exchanger. Embodiments disclosed herein allow routing the refrigerant piping to a far side slab in an efficient manner for high volume production, and/or removing the physical labor burden of insulating copper piping above the aluminum heat exchanger to mitigate corrosion concerns of copper ions in condensate falling on aluminum, and/or reducing assembly labor cost (due to less connection points in manufacturing).

It will also be appreciated that typically during maintenance/service of the oversized/multi-slab microchannel heat exchanger, typically the location a service person operate is at the near side. When the connections of the components (such as the inlet/outlet connectors) are made at the near side during manufacturing (as in the embodiments disclosed herein), labor reduction during maintenance/service can be achieved due to less connection points and due to the convenient location of service for the heat exchanger.

Aspects:

It is noted that any one of aspects 1-10 below can be combined with aspect 11.

Aspect 1. A multi-slab microchannel heat exchanger comprising:

a first slab, the first slab comprising:

a first inlet header;

a first outlet header; and a first plurality of tubes, wherein the first plurality of tubes is arranged successively in a direction along a length of the heat exchanger, each of the first plurality of tubes includes microchannels, the first plurality of tubes includes inlets and outlets, the inlets of the first plurality of tubes are in fluid communication with the outlets of the first plurality of tubes through the microchannels of the plurality of tubes, and the first inlet header is in fluid communication with the inlets of the first plurality of tubes, the first outlet header is in fluid communication with the outlets of the first plurality of tubes;

a second slab including a second inlet header and a second outlet header;

a first inlet connector fluidly connected to the first inlet header;

a first outlet connector fluidly connected to the first outlet header;

a second inlet connector fluidly connected to the second inlet header; and a second outlet connector fluidly connected to the second outlet header, wherein the first slab and the second slab are arranged successively in the direction along the length of the heat exchanger, the first inlet connector, the first outlet connector, the second inlet connector, and the second outlet connector are disposed at a same end of the heat exchanger.

Aspect 2. The heat exchanger according to aspect 1, wherein the first inlet connector, the first outlet connector, the second inlet connector, and the second outlet connector are disposed at a bottom of the heat exchanger.

Aspect 3. The heat exchanger according to aspect 1 or aspect 2, wherein the first slab and the second slab converge at a point in the direction along the length of the heat exchanger, the second inlet connector and the second outlet connector extend from the point to the same end of the heat exchanger in the direction along the length of the heat exchanger.

Aspect 4. The heat exchanger according to aspect 3, wherein the second inlet connector is disposed inside the second outlet connector, the second inlet connector and the second outlet connector extend concentrically from the point to the same end of the heat exchanger in the direction along the length of the heat exchanger.

Aspect 5. The heat exchanger according to aspect 3, wherein the second outlet connector is disposed inside the second inlet connector, the second inlet connector and the second outlet connector extend concentrically from the point to the same end of the heat exchanger in the direction along the length of the heat exchanger.

Aspect 6. The heat exchanger according to aspect 3, wherein the second inlet connector is disposed inside the first inlet header, the second inlet connector and the first inlet header extend concentrically from the point to the same end of the heat exchanger in the direction along the length of the heat exchanger.

Aspect 7. The heat exchanger according to aspect 3, wherein the second outlet connector is disposed inside the first outlet header, the second inlet connector and the first outlet header connector extend concentrically from the point to the same end of the heat exchanger in the direction along the length of the heat exchanger.

Aspect 8. The heat exchanger according to any one of aspects 1-7, wherein the second inlet connector and the second outlet connector are made of aluminum.

Aspect 9. The heat exchanger according to any one of aspects 1-8, further comprising:

a third slab;

a third inlet connector; and a third outlet connector, wherein the first slab, the second slab, and the third slab are arranged successively in the direction along the length of the heat exchanger.

Aspect 10. The heat exchanger according to aspect 9, the first inlet connector, the first outlet connector, the second inlet connector, the second outlet connector, the third inlet connector, and the third outlet connector are disposed at the same end of the heat exchanger.

Aspect 11. A refrigeration circuit, comprising:

a compressor;

an expansion device; and a multi-slab microchannel heat exchanger, the heat exchanger including:

a first slab, the first slab comprising:

a first inlet header;

a first outlet header; and a first plurality of tubes, wherein the first plurality of tubes is arranged successively in a direction along a length of the heat exchanger, each of the first plurality of tubes includes microchannels, the first plurality of tubes includes inlets and outlets, the inlets of the first plurality of tubes are in fluid communication with the outlets of the first plurality of tubes through the microchannels of the plurality of tubes, and the first inlet header is in fluid communication with the inlets of the first plurality of tubes, the first outlet header is in fluid communication with the outlets of the first plurality of tubes;

a second slab including a second inlet header and a second outlet header;

a first inlet connector fluidly connected to the first inlet header;

a first outlet connector fluidly connected to the first outlet header;

a second inlet connector fluidly connected to the second inlet header; and a second outlet connector fluidly connected to the second outlet header, wherein the first slab and the second slab are arranged successively in the direction along the length of the heat exchanger, the first inlet connector, the first outlet connector, the second inlet connector, and the second outlet connector are disposed at a same end of the heat exchanger, wherein the first outlet connector is fluidly connected to a first outlet conduit, the second outlet connector is fluidly connected to a second outlet conduit, the first outlet conduit and the second outlet connector are fluidly connected to a common outlet conduit, the common outlet conduit is fluidly connected to a suction conduit of the compressor, wherein the first inlet connector is fluidly connected to a first inlet conduit, the second inlet connector is fluidly connected to a second inlet conduit, the first inlet conduit and the second inlet connector are fluidly connected to a common inlet conduit, the common inlet conduit is fluidly connected to the expansion device.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A multi-slab microchannel heat exchanger comprising:

a first slab, the first slab comprising:

a first inlet header;

a first outlet header; and a first plurality of tubes, wherein the first plurality of tubes is arranged successively in a direction along a length of the multi-slab microchannel heat exchanger, each of the first plurality of tubes includes microchannels, the first plurality of tubes includes inlets and outlets, the inlets of the first plurality of tubes are in fluid communication with the outlets of the first plurality of tubes through the microchannels of the first plurality of tubes, and the first inlet header is in fluid communication with the inlets of the first plurality of tubes, the first outlet header is in fluid communication with the outlets of the first plurality of tubes;

a second slab including a second inlet header and a second outlet header, the direction of the length of the multi-slab microchannel heat exchanger being a direction extending from the first slab to the second slab;

a first inlet connector fluidly connected to the first inlet header;

a first outlet connector fluidly connected to the first outlet header;

a second inlet connector fluidly connected to the second inlet header; and a second outlet connector fluidly connected to the second outlet header, wherein the first slab and the second slab are arranged successively in the direction along the length of the multi-slab microchannel heat exchanger, the multi-slab microchannel heat exchanger has a first end and a second end in the direction of the length of the multi-slab microchannel heat exchanger, the first inlet connector, the first outlet connector, the second inlet connector, and the second outlet connector are disposed at the first end of the multi-slab microchannel heat exchanger.

2. The multi-slab microchannel heat exchanger according to claim 1, wherein the first inlet connector, the first outlet connector, the second inlet connector, and the second outlet connector are disposed at a bottom of the multi-slab microchannel heat exchanger.

3. The multi-slab microchannel heat exchanger according to claim 1, wherein the first slab and the second slab converge at a converging point in the direction along the length of the multi-slab microchannel heat exchanger, the second inlet connector and the second outlet connector extend from the converging point to the first end of the multi-slab microchannel heat exchanger in the direction along the length of the multi-slab microchannel heat exchanger.

4. The multi-slab microchannel heat exchanger according to claim 3, wherein the second inlet connector is disposed inside the first inlet header, the second inlet connector and the first inlet header extend concentrically from the converging point to the first end of the multi-slab microchannel heat exchanger in the direction along the length of the multi-slab microchannel heat exchanger.

5. The multi-slab microchannel heat exchanger according to claim 3, wherein the second outlet connector is disposed inside the first outlet header, the second outlet connector and the first outlet header extend concentrically from the converging point to the first end of the multi-slab microchannel heat exchanger in the direction along the length of the multi-slab microchannel heat exchanger.

6. The multi-slab microchannel heat exchanger according to claim 3, wherein the second inlet connector and the second outlet connector are made of aluminum.

7. The multi-slab microchannel heat exchanger according to claim 1, further comprising:

a third slab;

a third inlet connector; and a third outlet connector, wherein the first slab, the second slab, and the third slab are arranged successively in the direction along the length of the multi-slab microchannel heat exchanger.

8. The multi-slab microchannel heat exchanger according to claim 7, the first inlet connector, the first outlet connector, the second inlet connector, the second outlet connector, the third inlet connector, and the third outlet connector are disposed at the first end of the multi-slab microchannel heat exchanger.

9. A multi-slab microchannel heat exchanger comprising:

a first slab, the first slab comprising:

a first inlet header;

a first outlet header; and a first plurality of tubes, wherein the first plurality of tubes is arranged successively in a direction along a length of the multi-slab microchannel heat exchanger, each of the first plurality of tubes includes microchannels, the first plurality of tubes includes inlets and outlets, the inlets of the first plurality of tubes are in fluid communication with the outlets of the first plurality of tubes through the microchannels of the first plurality of tubes, and the first inlet header is in fluid communication with the inlets of the first plurality of tubes, the first outlet header is in fluid communication with the outlets of the first plurality of tubes;

a second slab including a second inlet header and a second outlet header, the direction of the length of the multi-slab microchannel heat exchanger being a direction extending from the first slab to the second slab;

a first inlet connector fluidly connected to the first inlet header;

a first outlet connector fluidly connected to the first outlet header;

a second inlet connector fluidly connected to the second inlet header; and a second outlet connector fluidly connected to the second outlet header, wherein the first slab and the second slab are arranged successively in the direction along the length of the multi-slab microchannel heat exchanger, wherein the multi-slab microchannel heat exchanger has a first end and a second end in the direction of the length of the multi-slab microchannel heat exchanger, wherein the first inlet connector, the first outlet connector, the second inlet connector, and the second outlet connector are disposed at the first end of the multi-slab microchannel heat exchanger, wherein the first slab and the second slab converge at a converging point in the direction along the length of the multi-slab microchannel heat exchanger, wherein the second inlet connector and the second outlet connector extend from the converging point to the first end of the multi-slab microchannel heat exchanger in the direction along the length of the multi-slab microchannel heat exchanger, wherein the second inlet connector is disposed inside the second outlet connector, or the second outlet connector is disposed inside the second inlet connector, and wherein the second inlet connector and the second outlet connector extend concentrically from the converging point to the first end of the multi-slab microchannel heat exchanger in the direction along the length of the multi-slab microchannel heat exchanger.

10. A refrigeration circuit, comprising:

a compressor;

an expansion device; and a multi-slab microchannel heat exchanger, the multi-slab microchannel heat exchanger including:

a first slab, the first slab comprising:

a first inlet header;

a first outlet header; and a first plurality of tubes, wherein the first plurality of tubes is arranged successively in a direction along a length of the multi-slab microchannel heat exchanger, each of the first plurality of tubes includes microchannels, the first plurality of tubes includes inlets and outlets, the inlets of the first plurality of tubes are in fluid communication with the outlets of the first plurality of tubes through the microchannels of the first plurality of tubes, and the first inlet header is in fluid communication with the inlets of the first plurality of tubes, the first outlet header is in fluid communication with the outlets of the first plurality of tubes;

a second slab including a second inlet header and a second outlet header, the direction of the length of the multi-slab microchannel heat exchanger being a direction extending from the first slab to the second slab;

a first inlet connector fluidly connected to the first inlet header;

a first outlet connector fluidly connected to the first outlet header;

a second inlet connector fluidly connected to the second inlet header; and a second outlet connector fluidly connected to the second outlet header, wherein the first slab and the second slab are arranged successively in the direction along the length of the multi-slab microchannel heat exchanger, the multi-slab microchannel heat exchanger has a first end and a second end in the direction of the length of the multi-slab microchannel heat exchanger, the first inlet connector, the first outlet connector, the second inlet connector, and the second outlet connector are disposed at the first end of the multi-slab microchannel heat exchanger, wherein the first outlet connector is fluidly connected to a first outlet conduit, the second outlet connector is fluidly connected to a second outlet conduit, the first outlet conduit and the second outlet conduit are fluidly connected to a common outlet conduit, the common outlet conduit is fluidly connected to a suction conduit of the compressor, wherein the first inlet connector is fluidly connected to a first inlet conduit, the second inlet connector is fluidly connected to a second inlet conduit, the first inlet conduit and the second inlet conduit are fluidly connected to a common inlet conduit, the common inlet conduit is fluidly connected to the expansion device.

* * * * *